US008002555B2

(12) United States Patent
Lee

(10) Patent No.: US 8,002,555 B2
(45) Date of Patent: Aug. 23, 2011

(54) ELECTRICAL CONNECTOR

(75) Inventor: Scott David Lee, Terrigal (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/593,939

(22) PCT Filed: Jul. 18, 2007

(86) PCT No.: PCT/EP2007/006369

§ 371 (c)(1),
(2), (4) Date: Sep. 30, 2009

(87) PCT Pub. No.: WO2008/119370

PCT Pub. Date: Oct. 9, 2008

(65) Prior Publication Data

US 2010/0048059 A1 Feb. 25, 2010

(30) Foreign Application Priority Data

Mar. 30, 2007 (AU) ..... 2007901719

(51) Int. Cl.
*H01R 29/00* (2006.01)

(52) U.S. Cl. ..... 439/49; 439/638

(58) Field of Classification Search ..... 439/49, 439/139–142, 638, 682, 693, 915
See application file for complete search history.

(56) References Cited

U.S. PATENT DOCUMENTS

| | | | | |
|---|---|---|---|---|
| 4,959,021 | A | 9/1990 | Byrne | |
| 5,074,804 | A | 12/1991 | Pantland et al. | |
| 6,159,020 | A | 12/2000 | Baker et al. | |
| 6,231,358 | B1 | 5/2001 | Kerr, Jr. et al. | |
| 7,232,331 | B2 * | 6/2007 | Dennes et al. | 439/404 |
| 7,503,799 | B2 * | 3/2009 | Keith et al. | 439/417 |
| D601,099 | S | 9/2009 | Lee | |
| D601,511 | S | 10/2009 | Lee | |
| 2006/0116021 | A1 | 6/2006 | Dennes et al. | |

FOREIGN PATENT DOCUMENTS

| | | |
|---|---|---|
| DE | 33 30 177 | 4/1985 |
| EP | 0 445 376 | 9/1991 |
| WO | WO 2004/010536 | 1/2004 |

* cited by examiner

*Primary Examiner* — Khiem Nguyen
(74) *Attorney, Agent, or Firm* — Merchant & Gould P.C.

(57) ABSTRACT

An electrical connector (100) comprises the following: (a) a first element (102) having an opening (114) for receiving an electrical cable (116), (b) a second element (104, 106) coupled to an electrical connector element (108), wherein the first element is coupled to the second element in order to define a cavity between the first and the second elements, wherein the connector element is in electrical contact with the cable in the cavity, and (c) an adjustable insulating shield (110) that is movable between a first position and a second position relative to the second element, such that a conductive contact section of the connector element is exposed for direct contact when the shield is moved to the first position, and that the shield covers the section in order to restrict direct access to the section when the shield is moved to the second position.

14 Claims, 4 Drawing Sheets

ELECTRICAL CONNECTOR

This application is a National Stage Application of PCT/EP2007/006369, filed 18 Jul. 2007, which claims benefit of Serial No. 2007901719, filed 30 Mar. 2007 in Australia and which applications are incorporated herein by reference. To the extent appropriate, a claim of priority is made to each of the above disclosed applications.

FIELD

The present invention relates to electrical connectors.

BACKGROUND

Electrical connectors connected to an electrical cable provide a convenient tool for making and breaking electrical connections with the cable. Electrical connectors may have contacts exposed in order to make an electrical connection. However, there is considerable risk to a user when using a connector with exposed contacts, and particularly, the risk of electrocution resulting from the user's inadvertent contact with a connector's exposed contacts when used to supply an electric current.

It is desired to provide an electrical connector that addresses one or more of the above, or to provide at least a useful alternative to existing electrical connectors.

SUMMARY

In accordance with the present invention there is provided an electrical connector, including:

(a) a first member having an opening for receiving an electrical cable;

(b) a second member coupled to an electrical connector element, said first member being coupled to said second member to define a cavity between said first and second members, said connector element being in electrical contact with said cable in said cavity; and (c) an adjustable insulation shield, moveable relative to said second member between a first position and a second position, such that when said shield is moved to said first position, a conducting contact portion of said connector element is exposed for direct contact, and when said shield is moved to said second position, said shield covers said portion to limit direct access to said portion.

In accordance with another aspect of the invention, there is provided a patch plug for electrically connecting a plurality of insulated conductors of an electronic data cable to corresponding contacts of a connector module, including (a) a housing shaped to receive the insulated conductors of the data cable;

(b) an electrical connector element including a first end coupled to the housing for electrical engagement with respective ones of said conductors, and a second end for electrically connecting said conductors to respective ones of said contacts of the connector module;

(c) an adjustable insulation shield, wherein the shield is adapted to move between a first position that electrically isolates the second end of the connector element from external contact, and a second position that electrically exposes the contact element for electrical connection to the contacts of the connector module.

BRIEF DESCRIPTION OF THE DRAWINGS

Preferred embodiments of the present invention are herein described, by way of example only, with reference to the accompanying drawings wherein.

DETAILED DESCRIPTION OF THE PREFERRED EMBODIMENTS

Figure 1:
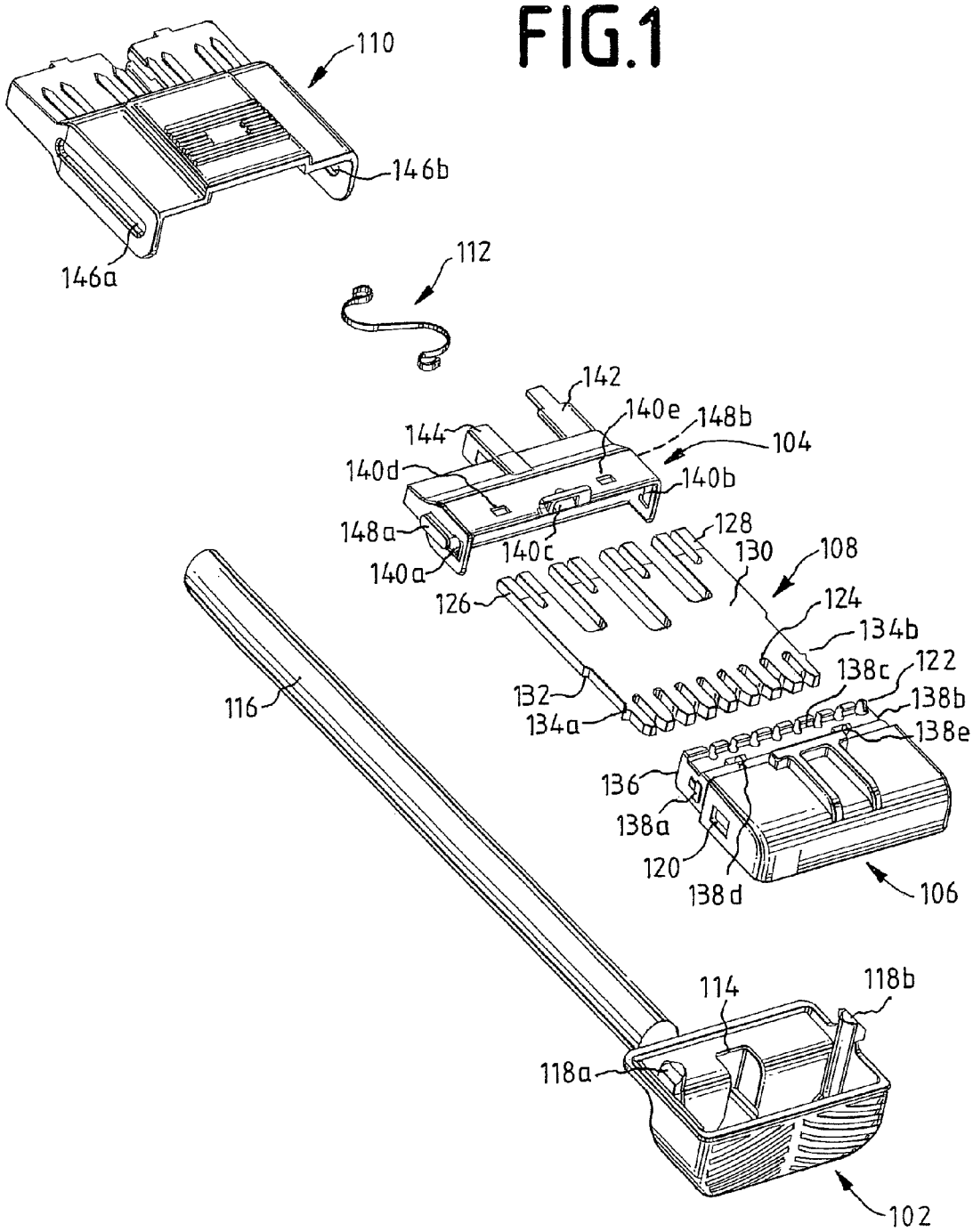
FIG. 1 is an exploded view of the electrical connector.

The electrical connector 100, as shown in FIG. 1, includes a first member 102, a second member (which is made up of an upper shell 106 and a lower shell 104), an electrical connector element 108, an insulation shield 110 and biasing means 112. The first member 102 has an opening 114 for receiving one or more wires from the electric cable 116. The connector 100 can be used with any type of electric cable 106. For example, the cable 116 may be a single-cored cable, or a multi-cored cable with wires corresponding to one or more twisted cables.

The first member 102 has a latching means formed on an inner surface of the member 102. The latching means includes one or more resilient latching posts 118*a* and 118*b*, each having an enlarged head portion which includes a shoulder that gradually increases the cross-sectional thickness of the head portion in a direction away from the exposed end of the latching post 118*a* and 118*b*. The head portion includes a flanged portion formed substantially at right angles to the length of the latching post 118*a* and 118*b*, which defines the transition from the larger cross-sectional thickness of the head portion to a smaller cross-sectional thickness of the latching post 118*a* and 118*b*. The latching post 118*a* and 118*b* on the first member 102 are aligned with a corresponding recess 120 formed in the second member 104, 106. When the first member 102 and second member 104, 106 are coupled together, the head portion of a latching post 118*a* and 118*b* engages within a corresponding recess 120 in the second member 104, 106 so that the resilience of the latching posts 118*a* and 118*b* securely holds the first member 102 and second member 104, 106 together.

The first member 102 and the upper shell 106 of the second member, when coupled together, define a cavity between the parts 102 and 106. The upper shell 106 of the second member includes one or more wiring slots 122, each for receiving the stripped end of a respective wire from the cable 116. When the stripped ends of wires are held in place by the wiring slots 122, the contact slots 124 formed on the electrical connector element 108 can engage with a corresponding stripped end of a wire within the cavity to establish electrical contact. For example, each contact slot 124 includes a surface made of a conducting material (e.g. copper) for directly contacting and making an electrical connection with the stripped end of a wire (not shown) held in place by a wiring slot 122. The size of each contact slot 124 is sufficiently small to securely grip the stripped end of a wire. The connector element 108 includes one or more fingers 126, each finger 126 having a contact portion 128 for making electrical contact. The connector element 108 is substantially flat, and has conducting paths formed on the upper surface 130 and/or the lower surface 132 to provide an electrical connection between each contact slot 124 with a respective contact portion 128 of a finger 126. The connector element 108 is preferably a printed circuit board with etched conducting paths on one or both sides 130, 132. In the arrangement shown in FIG. 1, the contact slots 124 for receiving wires of a twisted cable are connected by conducting paths to respective contact portions 128 on adjacent fingers 126. The connector element 108 is made for mating assembly with the upper shell 106. The connector element 108 includes one or more retaining notches 134*a* and 134*b* that engages with a corresponding retaining recess 136 formed in the upper shell 106 to securely couple the parts 106 and 108 together. The upper shell has one or more protrusions 138*a*, 138*b*, 138*c*, 138*d* and 138*e* that engages with a corresponding recess 140*a*, 140*b*, 140*c*, 140*d* and 140*e* formed in lower shell 104 to securely couple the parts 104 and 106 together.

The adjustable insulation shield 110 is made of a non-conductive material (e.g. PVC), and has one or more guiding slots 146*a* and 146*b* formed in the shield 110. In one embodiment, as shown in FIG. 1, the guiding slots 146*a* and 146*b* are formed through the wall of the shield 110. In another embodiment, the guiding slots 146*a* and 146*b* are recesses formed on the inner surface of the shield 110 but not formed through the wall of the shield 110. The guiding slots 146*a* and 146*b* engage with a corresponding guiding protrusion 148*a* and 148*b* formed on the outer surface of the lower shell 104, so that the shield 110 is able to move by sliding relative to the second member 104, 106, and wherein the movement of the shield 110 is guided by the guiding protrusions 148*a* and 148*b*, The guiding protrusions 148*a* and 148*b* are sufficiently long so as to maintain stability of the shield 110 during movement.

The shield 110 is moveable along the length of the second member 104, 106 between a first position and a second position, such that when the shield 110 is moved to the first position, the contact portions 128 of the fingers 126 are exposed for direct contact. When the shield 110 is moved to the second position, the shield covers the contact portions 128 of the fingers 126 to minimize direct contact with the contact portions 128.

The electrical connector 100 includes biasing means 112 that moves the shield 110 towards the second position. The biasing means 112 includes any form of a compression spring, and is preferably an S-shaped spring as shown in FIG. 1. The biasing means 112 is positioned between the shield 110 and the lower shell 104 of the second member, and the biasing means 112 pushes against a wall 144 of the lower shell 104 and an inner wall of the shield 110 to bias the shield 110 towards the second position.

Figure 2:
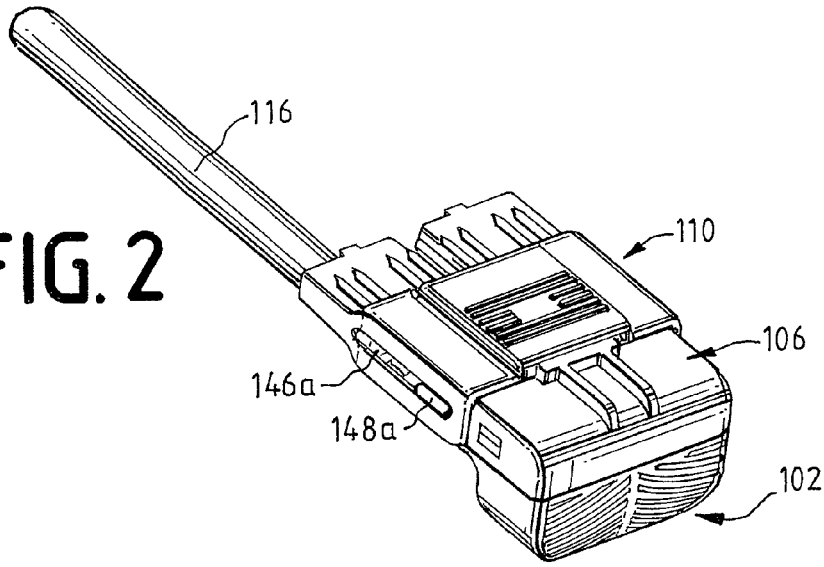
FIG. 2 is a perspective view of the electrical connector with the shield in an unterminated position.
Figure 3:
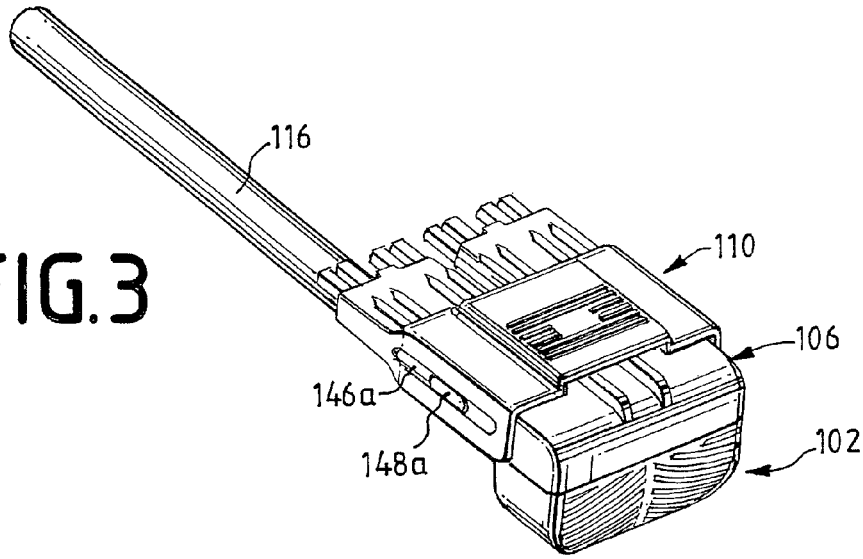
FIG. 3 is a perspective view of the electrical connector with the shield in a retracted position.
Figure 4:
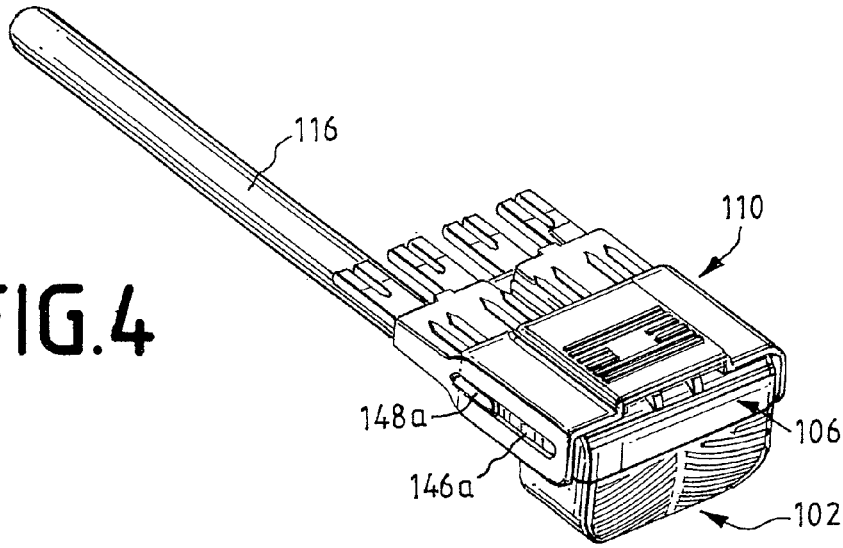
FIG. 4 is a perspective view of the electrical connector with the shield in a terminated position.

FIG. 2 is a perspective view of the electrical connector 100 with the shield 110 in the second position (i.e. unterminated position). FIG. 3 is a perspective view of the electrical connector 100 with the shield 110 in a partly retracted position moving towards the first position. FIG. 4 is a perspective view of the electrical connector 100 with the shield 110 in a first position (i.e. terminated position). Like numbering in FIGS. 2, 3 and 4 indicates like parts as shown in FIG. 1.

Figure 5:
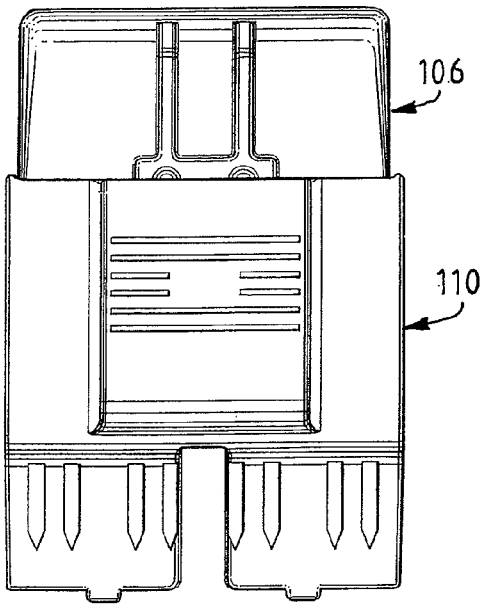
FIGS. 5, 6 and 7 are top, side and perspective views of the electrical connector arranged in a first configuration.
Figure 6:
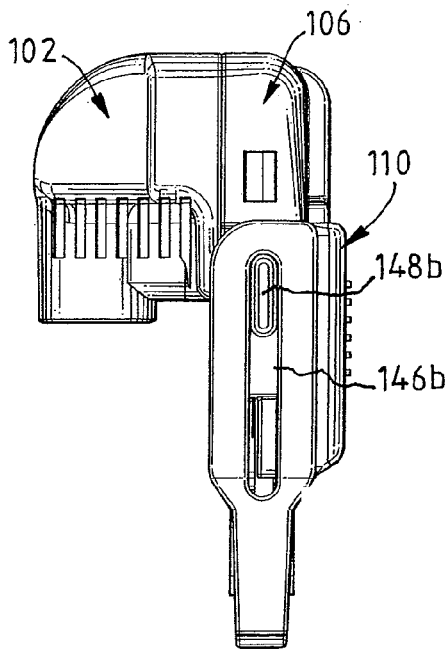
Figure 7:
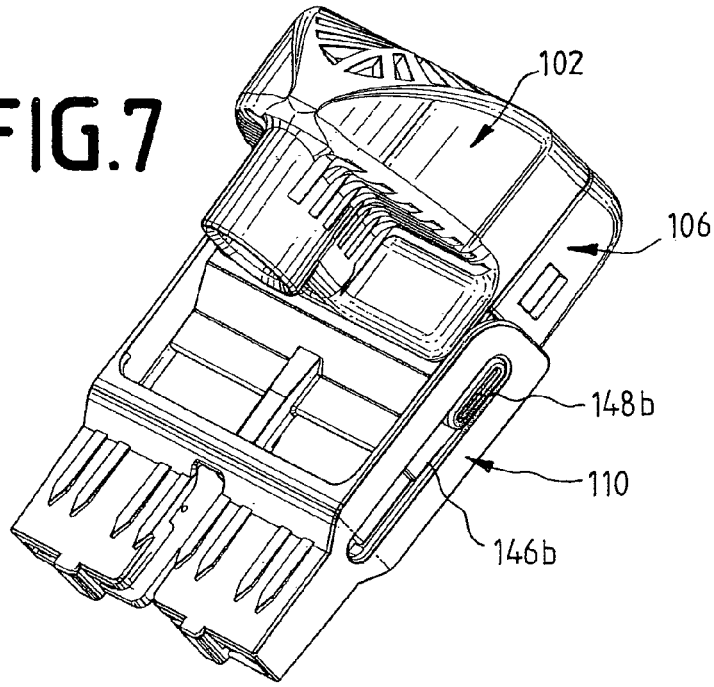
Figure 8:
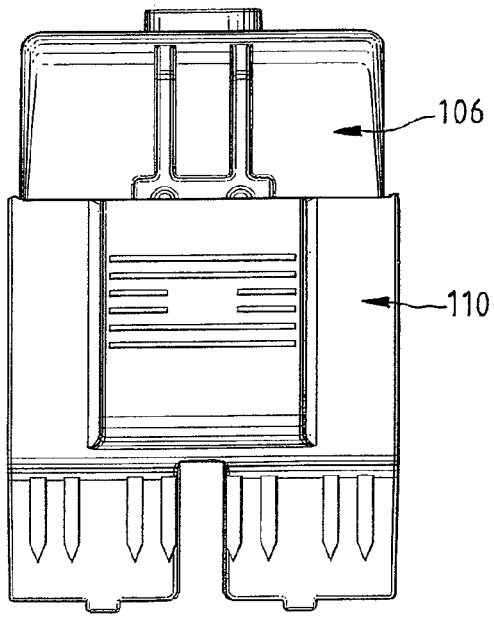
FIGS. 8, 9 and 10 are top, side and perspective views of the electrical connector arranged in a second configuration.
Figure 9:
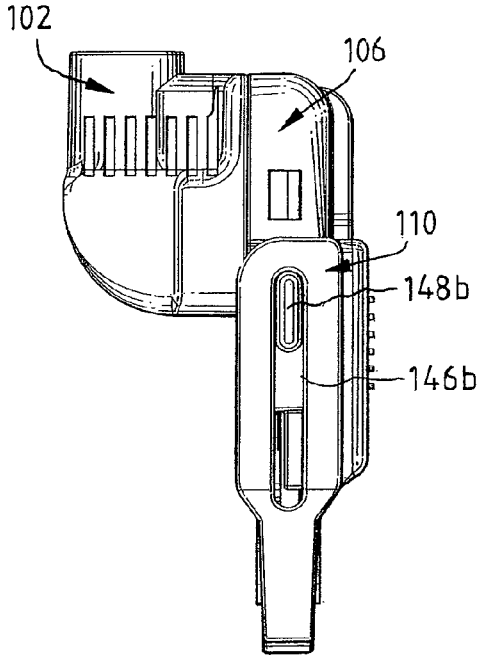
Figure 10:
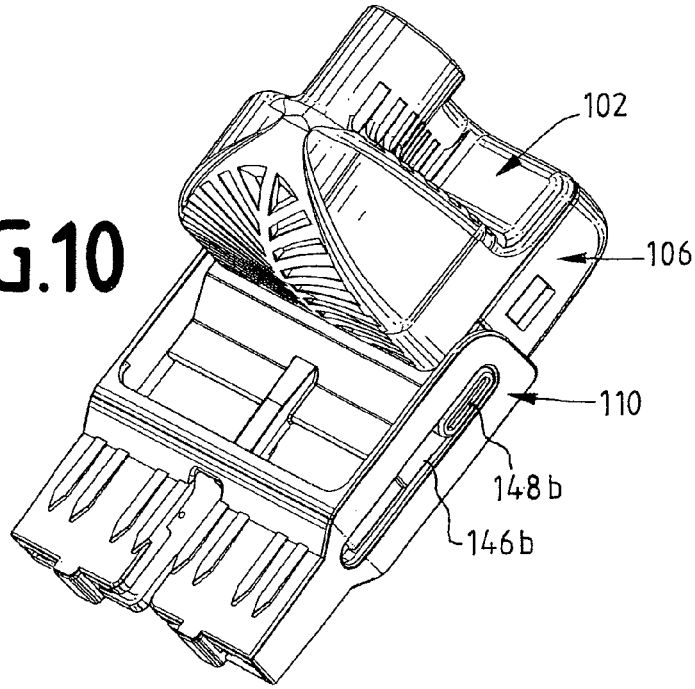

The first member 102 and the second member 104, 106 can be coupled together in one or more different orientations with respect to each other, after rotating the first member 102 and the second member 104, 106 relative to each other along respective planes in parallel to each other. FIGS. 5, 6 and 7 are top, side and perspective views respectively of the electrical connector 100 with the first member 102 arranged in a first configuration relative to the second member 104, 106. FIGS. 8, 9 and 10 are top, side and perspective views respectively of the electrical connector 100 with the first member 102 arranged in a second configuration relative to the second member 104, 106. In the first configuration, the first member 102 is coupled to the second member 104, 106 after a rotation of 180 degrees relative to the position of the first member 102 in the second configuration. The configuration of the latching posts 118*a* and 118*b* in the first member 102, and their respective alignment with recesses 120 in the second member 104, 106, are such that the first and second members 102, 104, 106 can be coupled in either a first configuration or a second configuration as described above.

Many modifications will be apparent to those skilled in the art without departing from the scope of the present invention as herein described with reference to the accompanying drawings.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A patch plug for electrically connecting a plurality of insulated conductors of an electronic data cable to corresponding contacts of a connector module, comprising:

(a) a first member having an opening for receiving the insulated conductors of the electronic data cable;

(b) a second member coupled to the first member to form a cavity;

(c) an electrical connector element positioned at least partially in the cavity, the electrical connector element including a first end coupled to the second member for electrical engagement with each one of said conductors, and a second end extending outwardly from the second member for electrically connecting said conductors to respective ones of said contacts of the connector module; and (d) an adjustable insulation shield, slideable relative to said second member between a first position and a second position, such that when said shield is moved to said first position, the second end of said connector element is exposed for electrical contact with the contacts of the connector module, and when said shield is moved to said second position, said shield covers said second end to inhibit access to said second end.

2. A patch plug as claimed in claim 1, including a biasing arrangement configured to move said shield towards said second position.

3. A patch plug as claimed in claim 2, wherein said biasing arrangement includes a compression spring.

4. A patch plug as claimed in claim 3, wherein said compression spring includes an S-shaped spring, said spring being positioned between said shield and said second member.

5. A patch plug as claimed in claim 1, wherein said shield moves along a length of said second member.

6. A patch plug as claimed in claim 1, wherein said shield includes one or more guiding slots, the movement of said shield being guided by one or more guiding protrusions fitted within said guiding slots, each of said one or more guiding protrusions being formed on an exterior surface of said second member.

7. A patch plug as claimed in claim 1, wherein said first member and said second member are coupled together by a latching arrangement formed on one of said first and second members, and a recess formed in the other of said first and second members.

8. A patch plug as claimed in claim 7, wherein said latching arrangement includes a resilient latching post having an enlarged head portion that engages with a said recess so as to securely hold said first member and said second member together.

9. A patch plug as claimed in claim 1, wherein said first member and said second member are configured to be coupled together in one or more different orientations after rotating said first member and said second member relative to each other along respective planes in parallel to each other.

10. A patch plug as claimed in claim 1, wherein said connector element is arranged for mating assembly with said second member.

11. A patch plug as claimed in claim 1, wherein the connector element has a plurality of contact slots for making electrical contact with respective ones of said conductors in said cable, said connector element having a plurality of conducting paths electrically connecting said contact slots to respective contact portions formed on a fingers of the second end of the connector element.

12. A patch plug as claimed in claim 1, wherein said connector element is a printed circuit board.

13. A patch plug as claimed in claim 1, including a fastener for inhibiting movement of the shield from the second position towards the first position.

14. A patch plug as claimed in claim 13, wherein the fastener is a latch.

* * * * *

UNITED STATES PATENT AND TRADEMARK OFFICE

CERTIFICATE OF CORRECTION

PATENT NO. : 8,002,555 B2
APPLICATION NO. : 12/593939
DATED : August 23, 2011
INVENTOR(S) : Lee It is certified that error appears in the above-identified patent and that said Letters Patent is hereby corrected as shown below:

Col. 6, line 3, claim 11: "formed on a fingers" should read --formed on fingers--

Signed and Sealed this
Tenth Day of April, 2012

David J. Kappos

David J. Kappos
*Director of the United States Patent and Trademark Office*